US010058189B2

(12) United States Patent
Petrov

(10) Patent No.: US 10,058,189 B2
(45) Date of Patent: Aug. 28, 2018

(54) ACTIVE MULTICOMPARTMENTAL PRESSURE REDISTRIBUTION SYSTEM

(71) Applicant: Stan C. Petrov, Costa Mesa, CA (US)

(72) Inventor: Stan C. Petrov, Costa Mesa, CA (US)

(73) Assignee: INTUITION VENTURES, INC., Newark, NJ (US)

( * ) Notice: Subject to any disclaimer, the term of this patent is extended or adjusted under 35 U.S.C. 154(b) by 353 days.

(21) Appl. No.: 14/816,184

(22) Filed: Aug. 3, 2015

(65) Prior Publication Data

US 2016/0037939 A1 Feb. 11, 2016

Related U.S. Application Data

(60) Provisional application No. 62/033,480, filed on Aug. 5, 2014.

(51) Int. Cl.

| | |
|---|---|
| ***A47C 27/08*** | (2006.01) |
| ***A43B 13/20*** | (2006.01) |
| ***A43B 17/03*** | (2006.01) |
| ***A47C 27/10*** | (2006.01) |
| ***A61G 7/057*** | (2006.01) |

(52) U.S. Cl.

CPC ..... *A47C 27/083* (2013.01); *A43B 13/203* (2013.01); *A43B 17/035* (2013.01); *A47C 27/085* (2013.01); *A47C 27/10* (2013.01); *A61G 7/05738* (2013.01)

(58) Field of Classification Search

CPC ..... A47C 27/083; A47C 27/085; A47C 27/10; A61G 7/05738; A43B 17/03; A43B 17/035; A47B 13/203; A47B 13/20

See application file for complete search history.

(56) References Cited

U.S. PATENT DOCUMENTS 4,852,195 A * 8/1989 Schulman ..... A61G 7/05776 297/DIG. 8
5,363,570 A * 11/1994 Allen ..... A43B 13/189 36/114
5,406,719 A * 4/1995 Potter ..... A43B 13/203 36/28
5,419,612 A * 5/1995 Rassekhi ..... B62J 1/26 297/200

(Continued)

OTHER PUBLICATIONS

PCT International Search Report and Written Opinion, PC/US2015/043744, filed Aug. 5, 2015, U. S. Search Authority, dated Sep. 2015, 9 pages.

(Continued)

*Primary Examiner* — Peter M. Cuomo
*Assistant Examiner* — David R Hare

(57) ABSTRACT

An interconnected multicompartmental pressure redistribution system that is able to precisely identify contact pressure points and address excess pressure on the body by redistributing the pressure in real time. Sensors that are part of a matrix of fluid substance-filled interactive pixels communicate with a microcontroller that may also be in wireless communication with a smart device. The microcontroller controls the individual fluid flow regulators located between the interactive pixels. This causes specific flow regulators to open, allowing the fluid substance to flow from one interactive pixel to another, redistributing pressure, as needed.

15 Claims, 5 Drawing Sheets

(56) References Cited

U.S. PATENT DOCUMENTS

| | | | | |
|---|---|---|---|---|
| 5,640,731 | A * | 6/1997 | Toedter | A47C 21/046 5/710 |
| 5,813,142 | A * | 9/1998 | Demon | A43B 3/0005 36/28 |
| 6,430,843 | B1 * | 8/2002 | Potter | A43B 3/0005 36/28 |
| 6,892,477 | B2 * | 5/2005 | Potter | A43B 3/0005 36/153 |
| 9,060,564 | B2 * | 6/2015 | Langvin | A43B 7/144 |
| 9,131,748 | B2 * | 9/2015 | James | A43B 13/189 |
| 9,549,585 | B2 * | 1/2017 | Amos | G01C 22/006 |
| 2002/0027384 | A1 | 3/2002 | Zur | |
| 2004/0237201 | A1 | 12/2004 | Fraser et al. | |
| 2007/0129907 | A1 * | 6/2007 | Demon | A43B 3/0005 702/127 |
| 2009/0013475 | A1 | 1/2009 | Friedrichs | |
| 2010/0268121 | A1 * | 10/2010 | Kilborn | A61B 5/412 600/587 |
| 2014/0039351 | A1 * | 2/2014 | Mix | A61B 5/1114 600/587 |
| 2014/0059781 | A1 | 3/2014 | Lafleche et al. | |
| 2014/0101862 | A1 | 4/2014 | Misaki | |

OTHER PUBLICATIONS

European Extended Search Report, EP Application No. 15830645.6, Europe Patent Office, dated Feb. 2, 2018, 8 pages.

* cited by examiner

ACTIVE MULTICOMPARTMENTAL PRESSURE REDISTRIBUTION SYSTEM

CROSS REFERENCE TO RELATED APPLICATIONS

This application claims the benefit of provisional application No. 62/033,480 filed Aug. 5, 2014 for Intelligent Multicompartmental Pressure Redistribution System. The entire application is incorporated herein by reference.

BACKGROUND OF THE INVENTION

1. Field of the Invention

The present invention relates to a pressure redistribution system, and more specifically to an active intelligent pressure redistribution system for use in connection with a human body, for example.

2. Description of Related Art

Human bodies are constructed to withstand and distribute force, preventing the damage that excessive pressure can cause. However, there is no doubt that excessive pressure with resultant damage does occur, particularly when an individual is unable to move freely, incapable of sensing pressure sufficiently, or just forced to ignore appropriate pain signals. The results can include pressure ulcers in those who are bed-ridden or wheelchair bound, foot ulcers in those with peripheral neuropathy due to chemotherapy or diabetes, and all kinds of foot, leg and back problems in those who wear shoes. For example, forces created by simply standing (static) or walking (kinetic) give rise to large amounts of stress, which can cause tremendous damage, not just to the feet, but also to the ankles, legs, hips and even back.

Whenever skin is sandwiched between a body part and another surface, be it a bed, a chair or a pair of shoes, the resultant forces are translated into multiple points of pressure. These locations and the number of these points of pressure are not static or predictable. Rather, they are governed by multiple factors including environment, genetics, pathologies, age, etc.

In the case of shoes, the fact that no person is completely symmetrical, meaning that one leg is always shorter than the other is a further complicity factor. Moreover, the weight of a person, or the type of shoe being worn will also impact the amount of pressure experienced, at various pressure points. A healthy foot will distribute this differential pressure as evenly as possible, preventing skin breakdown, joint damage, problems with ligaments and tendons, for example, that would normally result from this kind of pressure.

As is apparent from the large numbers of foot surgeries, orthotic devices, and patients visiting podiatric and orthopedic surgeons, this weight distribution may not be the norm. It has been estimated that 25% of the older population experiences foot pain on a daily basis and that 75% of the population will experience debilitating foot problems at least once in their lifetime. On average, a person will take 10,000 steps a day. Those in the military services or in active jobs take many more. All this may lead to increased foot-related problems. To make matters worse, changes in our environment over the last few centuries, requiring walking on hard and unyielding surfaces, wearing of "fashion" shoes, and eating more than is healthy, have placed new demands on the feet.

To address these problems and to help comfort and protect the various parts of the body, various devices such as mattresses, cushions, special chairs, shoes, orthotics, and inserts have been used. Research into better footwear is being actively pursued. Shoes that contain microcontrollers, motors, flow regulators, containment vessels, or a combination of these have been to devised. However, none of these devices gather information to specifically and precisely adjust interconnected vessels to compensate for excess pressures in real time. In fact, many devices are designed with little consideration of biomechanics and, while somewhat functional, are mostly passive. When sensors are used, they can only collect certain types of data that may help to identify a problem. This data is not used to make a dynamic real time change in a structure that will address the problem.

The majority of, if not all, mattresses, cushions, chairs and foot gear today rely on the use of springs, rubber, foam, and polymers to decrease pressure or redistribute areas of high pressure. These materials inevitably eventually deform, losing even their limited efficacy. In the case of shoes, such cushioning locks the foot in certain positions and effectively limits the range of motion. This prevents translating and evenly distributing the forces, in order to relieve points of pressure. This can be seen in new military recruits with boots that immobilize the foot. The extra force being applied from routine military exercises leads to a stress fracture rate of approximately 13-40%.

Over 8% of Americans today struggle with diabetes, and the number is rising. This debilitating disease affects the feet in a number of ways. First, ensuing neuropathy results in patients not having the sensory ability to know when standing in a particular position or walking in a particular way is causing pain, blisters, or other skin breakdown. Whereas a healthy person adjusts their gait to favor the injured part, a diabetic person does not. When injury occurs, the diminished vascularization of the lower limbs and the impaired immune system of a diabetic person results in healing delays, if healing occurs at all. Ulcers form in 15% of diabetics, infection may set in, and in 3-7% of diabetics the end result is amputation. This peripheral neuropathy is also a common side effect of chemotherapy, sometimes even making it difficult for patients to balance and walk.

The industry has developed products designed to address this issue. Nike has a shoe with embedded sensors that collect data when the wearer moves, sending it to an iPhone. This is useful when coordinating movement with a video game, but does not cause the shoe to adjust its shape to assist the wearer.

Puma has shoes with a mobium band that expands the shoe as the foot changes in shape during activity. The Puma shoe does not have sensors and does not adjust in response to the needs of the foot.

Adidas has a shoe with the Boost, that uses thermoplastic polyurethane granules with improved rebound, and MiCoach sensors that measure the speed and distance travelled of a runner. These only provide data.

Dr. Scholl makes custom fit orthotics that are molded to the foot according to data from sensors, but the orthotics are static.

Accustep shoes may contain a pedometer. The manufacturer claims that they give the wearer a massage with every step. This is achieved via beads, not a dynamic system.

Google has devised footwear that communicates via Bluetooth. The purpose is to connect with Google maps on their smartphone, and instruct the wearer where to walk through vibration.

Systems like that shown in U.S. Pat. No. 5,813,142 titled Shoe Sole With Adjustable Support Pattern use fluid bladders that are not interconnected and fluid does not flow between bladders. No data is collected and sent to a server, for example.

The present invention has the ability to collect data and self-adjust in a biomechanically informed manner. That makes it invaluable for preventing pressure ulcers in the bed-ridden and wheel chair bound persons, reducing stress fracture rates in the military and athletes, decreasing ulceration, amputation and even mortality in diabetics (a recent study saw a 50% reduction in the need for amputation by changes in footwear alone), cancer survivors, and others with neuropathic changes in their feet. Benefiting the general public who often stand, walk, and run on unnatural surfaces, sometimes in shoes that are more fashionable then sensible. Increasing comfort for all who use beds and chairs, and even providing users and care providers with invaluable data, such as user sleep patterns, the pressure points caused by various devices, gait analysis, and more.

In conclusion, there are pressure redistribution devices that contain a battery, sensors, containment vessels, and even microcontrollers with preset points, but none provide an intelligent dynamic system that is capable of precisely redistributing pressure in real time.

SUMMARY OF THE INVENTION

The current invention is able to precisely identify contact points and reduce excessive pressure by redistributing it in real time according to algorithms that synthesize gathered data with biochemical principles. A combination of hardware, including a dynamic pressure system, sensors and software that includes dynamic and static algorithms provides the immeasurable benefits of the invention.

A preferred embodiment of the invention uses a set of two Active Multicompartmental Pressure Redistribution System (AMPRS) (shoes, soles or inserts) that communicate with each other. Each sole is constructed from interactive pixels (fluid containing vessels), which are interconnected, each pixel being in contact with various sensors. The number and size of interactive pixels can vary depending on the application. In the case of mattresses, furniture, and wheelchairs, AMPRS units can be paired by having more than one in the same device or having the settings from one mattress (e.g. home) wirelessly communicated to another (e.g. hotel), again for the ultimate comfort of the user. Each interactive pixel is equipped with multiple flow regulators connecting the containment vessels or pixels at different locations. Adjacent interactive pixels are interconnected. A microcontroller receives appropriate input from the sensors that are part of the interactive pixels. It responds, using specific software to energize the flow regulators. This allows a fluid substance, such as a gas, liquid or gel, to be able to move from one containment vessel to another, thus relieving pressure in one specific area of the interactive pixels, and redistributing to other adjacent pixels. Moreover, the microcontrollers in the left AMPRS unit is able to communicate with the microcontrollers in the right and vice versa.

This system of the present invention will detect and precisely address excess pressures by actively redistributing forces in real time. Furthermore, it has the ability to learn about users. Besides making precise, real time and continuous adjustments based on input, it will be able to create a range of user-specific set points. The use of the invention in shoes, for example, will decrease both abnormal stress on normal feet and normal stress on abnormal feet structures."

BRIEF DESCRIPTION OF THE DRAWINGS

The exact nature of this invention, as well as the objects and advantages thereof, will become readily apparent from consideration of the following specification in conjunction with the accompanying drawings in which like reference numerals designate like parts throughout the figures thereof and wherein.

DETAILED DESCRIPTION OF THE PREFERRED EMBODIMENT

Figure 1:
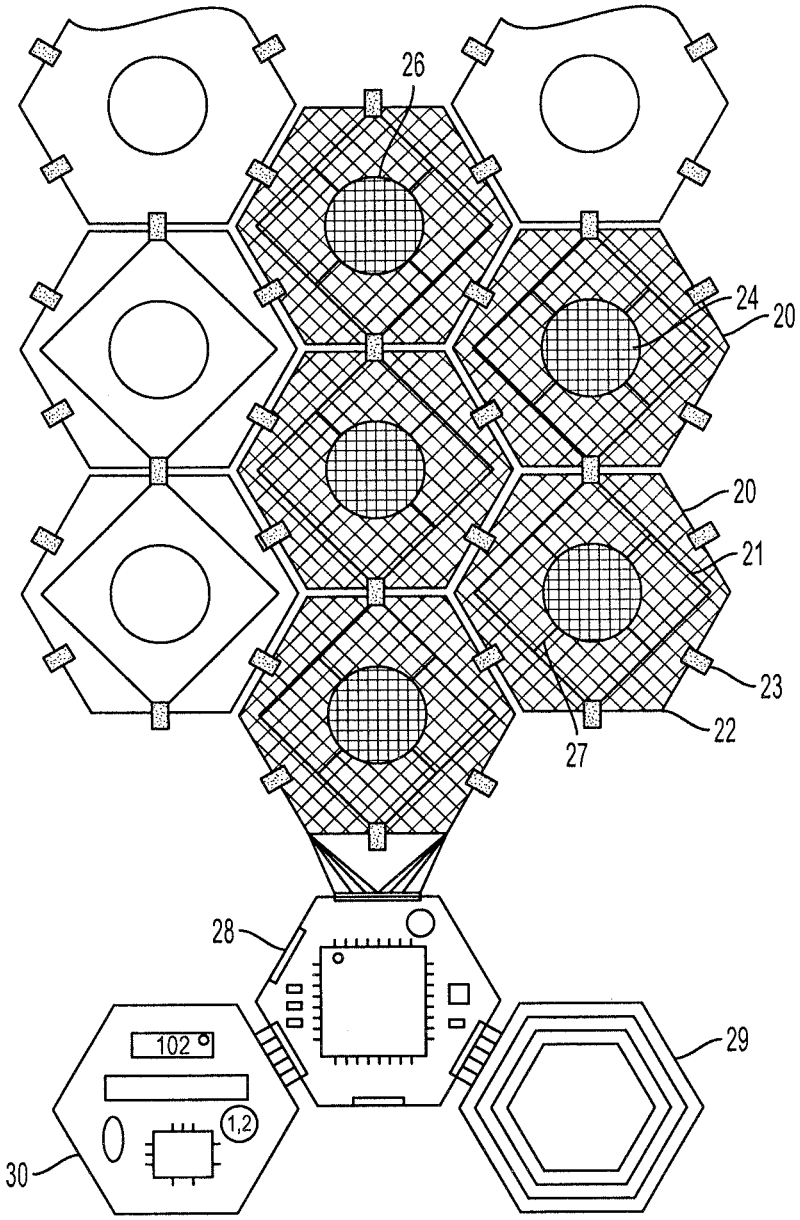
FIG. 1 is a diagrammatic illustration of interactive pixels, flow regulators, sensors, and electronic components.
Figure 2:
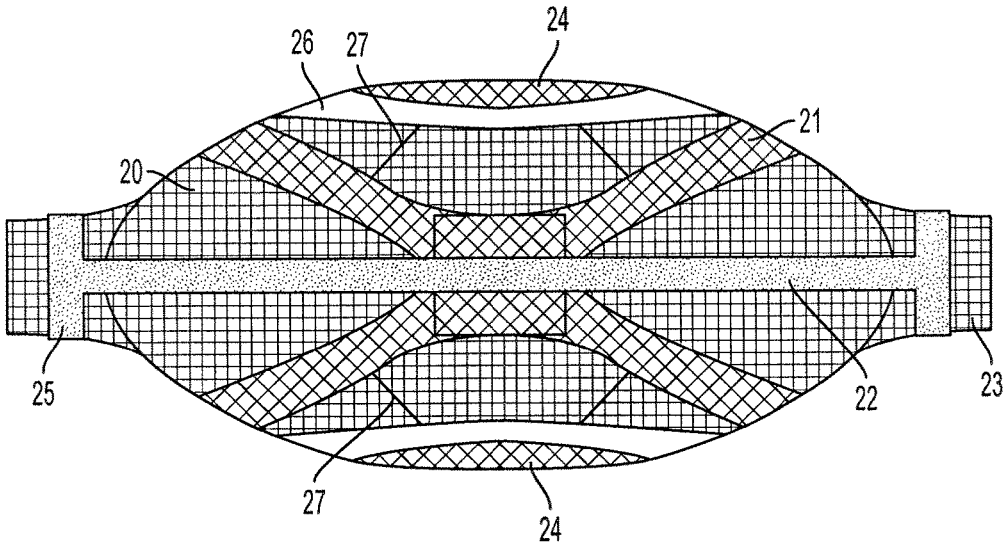
FIG. 2 is a diagrammatic side view illustration of a single interactive pixel showing its structure in detail.
Figure 3:
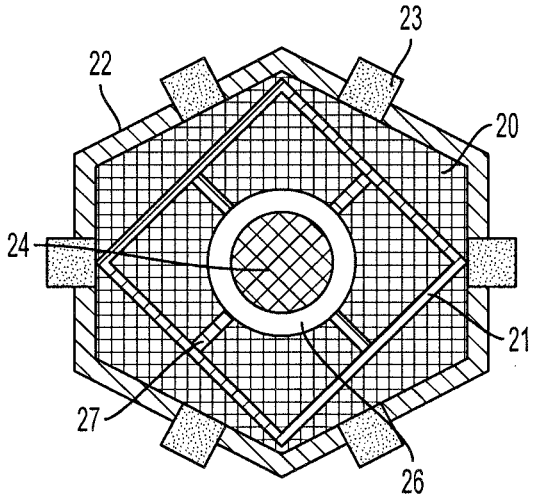
FIG. 3 is a diagrammatic top view illustration of a single interactive pixel showing its multi angular structure, flow regulators, sensors, and reinforcing structure.

A preferred embodiment of a multi-compartmental pressure redistribution system is illustrated in FIGS. 1, 2 and 3 as having containment vessels 20. The containment vessels are constructed of elastic impermeable material and filled with a fluid substance like a liquid, gas or gel, for example. In order to prevent failure of the vessel walls due to excessive force, the containment vessels 20 are reinforced with semi-elastic reinforcement bands 21. These bands prevent bulging of the vessel walls. These bands are attached to a semi-flexible frame 22 that seals the containment vessels 20 by fusing the layers and preventing leakage. The frame 22 of each vessel 20 also houses the flow regulators 23.

The flow regulators 23 interconnect the containment vessels 20 into a matrix as shown in FIG. 1. They may be positioned on and through multiple sides of each vessel. Based on the requirements of a specific application, these dynamic flow regulators may be passive (uni- or bi-directional) or active (micro-controller regulated). In the passive case, the multicompartmental pressure redistribution system relies on the passive movement of the fluid substance from one containment vessel to another in response to pressure exerted by a foot or other body part. The fluid will move from an area of higher pressure to an area of lower pressure. The multitude of containment vessels interconnected by passive flow regulators is a passive matrix. In the active case (active matrix), the regulators are actively controlled. Sensors 24 in the vessels are connected to the regulators, which are also connected to a microcontroller. The micro controller provides precise active control of each flow regulator.

The main group of sensors 24 are located directly above and below, as well as affixed to, each containment vessel, as best shown in FIG. 2. The sensors are bilaterally sandwiched between the body contact surface and the containment vessel wall, and between the shoe, mattress, chair or other surface and the containment vessel. A preferred embodiment may contain temperature and moisture sensors (not shown), as well as the pressure sensor 24. Other sensors may also be included. The flow regulators 23 may also be coupled to flow sensors 25, as shown in FIG. 2. The flow sensors are not part of the main group of sensors (based on location). The main group of sensors 24, are each held in place by a soft flexible ring 26 that provides both compression and tension, as shown in FIGS. 1-3. The sensor 25, flow regulator 23 and containment vessel 20 is referred to for convenience as an interactive pixel. The interactive pixel represents the smallest functional unit of the system. FIGS. 2 and 3 illustrate a complete interactive pixel. As described above, a matrix of interactive pixels interconnected by these flow regulators 23 and paired with the electronic components described below, is referred to for convenience as an active matrix.

The ring 26 on each vessel 20 is held in place by electrically and light conductive materials 27. This material carries signals from the various sensors 24, 25 to a microcontroller 28. These materials are also integrated in the indented spaces between the interactive pixels. The microcontroller 28 has both analog and digital input and output, as shown in FIG. 1. It utilizes a power pixel 29 with a battery and charging coil. The microcontroller 28 is also connected to a communication pixel 30 that contains antennae and other communication and identification hardware. These structures are attached to the active matrix, typically in areas where they are exposed to minimum pressure. The communication 30, power 29 and microcontroller 28 pixels are also placed under a gel-like material (not shown) to encapsulate them from inadvertent damage.

Figure 4:
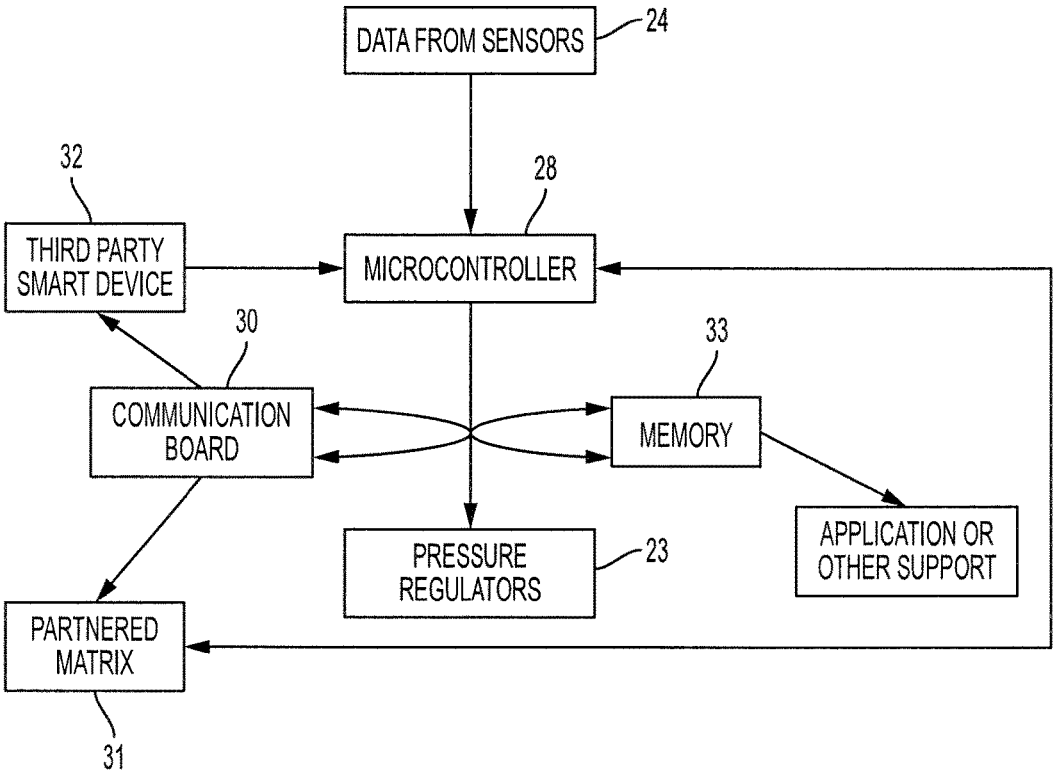
FIG. 4 is a block diagram of the communication system of the invention showing the information flow.

FIG. 4 shows the data flow within a preferred embodiment of the invention. During the initial set up time, the active matrix collects data from the various sensors 24, 25 that are interconnected with the microcontroller 28. Using software and custom algorithms, the microcontroller 28 may calculate the distribution and specific location of pressure points. Pressure regulators 23 are energized in response, allowing specific amounts of fluid to pass from high to low pressure interactive pixels, redistributing the pressure and providing maximal comfort to the user. The data collected from the sensors is sent by a communication circuit board 30 to another active matrix 31 and to and from a third device 32 such as a smart enabled device or remote server. Collection of this data contributes to improving in functionality and control. Some of the data is stored on the local microcontroller 28 and memory 33. This data is used to add functionality at times when other data may be unavailable and for additional purposes, such as, for example, recognition of the wearer, enabling the device to anticipate events, coordinating one device with another, sensing developing pathologies, and sensing sleep patterns.

Once the initial set up of the active multicompartmental pressure redistribution system is complete and enough data is stored, the active matrix begins to adjust to the user. By utilizing stored data and comparing it to real time data, it can detect abnormal events, such as excess pressure or heat in one area. If excess pressure is detected in an area, the microcontroller will send a signal to the individual flow regulators, causing certain flow regulators to open, allowing the fluid substance to move from high pressure to low pressure interactive pixels in a controlled manner. This controlled movement of the fluid substance allows for responsive, dynamic and even redistribution of pressure in real time. The result is efficiently and evenly redistributing the forces created between the body and the various surfaces with which the system comes in contact.

Figure 5A:
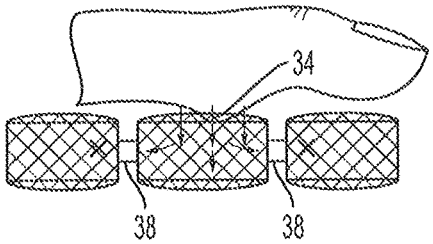
FIG. 5A is a graphical illustration of the interactive pixels interacting with a foot to redistribute pressure on the foot.
Figure 5B:
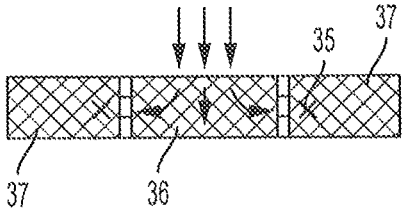
FIG. 5B is a graphical illustration of the interactive pixels interacting with each other to redistribute pressure.
Figure 5C:
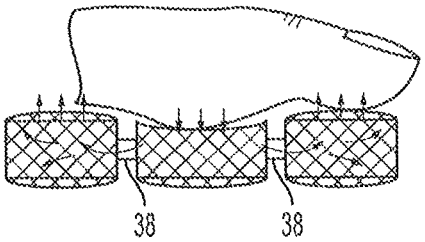
FIG. 5C is a graphical illustration of the interactive pixels interacting with a foot to redistribute pressure on the foot.
Figure 5D:
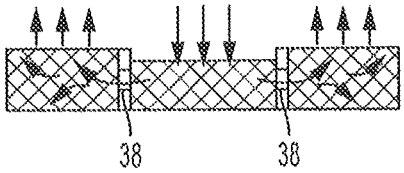
FIG. 5D is a graphical illustration of the interactive pixels interacting with each other to redistribute pressure.
Figure 5E:
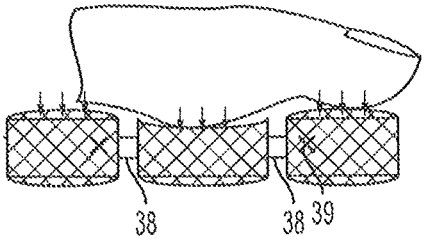
FIG. 5E is a graphical illustration of the interactive pixels interacting with a foot to redistribute pressure on the foot.
Figure 5F:
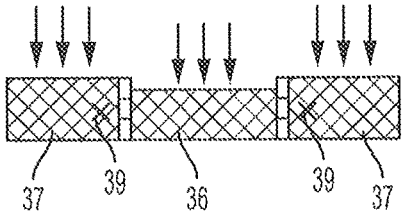
FIG. 5F is a graphical illustration of the interactive pixels interacting with each other to redistribute pressure.

FIGS. 5A, 5B, 5C, 5D, 5E and 5F illustrate the action of an active matrix in response to high pressure in a specific area of the interactive pixel matrix. Since neither the body nor that with which it is in contact are completely flat surfaces, areas of high and low pressure are created. The highest pressure will be at the apex 34 of an uneven surface, a toe, for example. In the case of an inflammation for example, those areas will be the warmest as well. This heat may be detected by embedded temperature sensors. FIG. 5A and FIG. 5B illustrate what occurs when pressure regulators 35 are closed. The pressure regulators are closed at all times unless energized. The fluid substance within the interactive pixel at the apex 36 (FIG. 5B) will experience the highest pressure. The fluid substance in interactive pixels 37 around the apex 36 will be at a lower pressure.

In order to reduce excess pressure at the apex 36, the microcontroller selectively opens the flow regulators 38 (FIGS. 5C, 5D) located between the high and low pressure interactive pixels for a predetermined amount of time. The exact time parameters will depend on self set or preset values. The normal state of each interactive pixel is to be partially full. The fluid substance will be transferred between the compartments connected by open flow regulators, from high pressure to low pressure.

When the difference in pressure between the apex 36 and the surrounding interactive pixels 37 begins to equalize and the desired pressure value is reached at the apex 36, the microcontroller de-energizes the flow regulators 38 causing them to close. Figures SE and SF show that when the flow regulators 38 again close, flow of fluid substance between the pixels is prevented 39. This results in partially deflated pixels at the former pressure apex 34 and more inflated pixels around the apex 37 and former high pressure pixel 36, absorbing more force so that pressure is redistributed over a larger area of the foot, for example with minimal energy use.

With the aid of the microcontroller 28, the memory 33, optional smart device 32 and certain algorithms that are part of the software of the system, the system can determine patterns, anticipate areas of high pressure, and self-adjust in real time. To make it more effective and functional, the active matrix may be programmed to adjust until a certain amount of battery power is left. At that point, the matrix will readjust to its optimal shape, based on data collected during previous use. Thus, when power is lost, the user will still be able to experience the best static force pressure distribution, similar to a functional orthotic device.

Operation of the system is based on biomechanical principles utilizing more than one matrix so that data may be exchanged between multiple units of the invention. This makes it possible to engage and offload multiple areas of the body simultaneously. Since sensor data and data from the smart device and remote location will continuously be monitored and integrated, in the preferred embodiment, this may reduce hip, knee, and other joint pain, as well as helping to prevent foot injury and ulceration. It will be possible to shift pressure from one area of the body to another, thereby preventing injury and ulceration.

What is claimed is:

1. An active multicompartment pressure redistribution system, comprising:

a plurality of containment vessels filled with a fluid substance arranged in a matrix, each containment vessel surrounded by three or more containment vessels, each containment vessel directly connected to each one of the three or more surrounding containment vessel by respective three or more fluid flow channels;

a plurality of flow regulators, a flow regulator located in each fluid flow channel;

a plurality of pressure sensors, at least one pressure sensor located on each containment vessel; and a microcontroller connected for communication with the plurality of pressure sensors and plurality of flow regulators;

whereby the microcontroller activates the flow regulators in response to data received from the pressure sensors.

2. The active multicompartment pressure redistribution system of claim 1 wherein each containment vessel is filled with a fluid that is one of a liquid, gas, or gel.

3. The active multicompartment pressure redistribution system of claim 1 wherein each containment vessel is a hexagon made from an elastic fluid impermeable material.

4. The active multicompartment pressure redistribution system of claim 1 wherein the containment vessel walls are reinforced by semi-elastic bands.

5. The active multicompartment pressure redistribution system of claim 4 wherein each containment vessel further comprises a semi-flexible frame to which the semi-elastic bands attach.

6. The active multicompartment pressure redistribution system of claim 5 wherein the flow regulators are contained in the semi-flexible frame of the containment vessel.

7. The active multicompartment pressure redistribution system of claim 1 wherein the pressure sensors comprise one pressure sensor above the containment vessel and one pressure sensor below the containment vessel.

8. The active multicompartment pressure redistribution system of claim 1 further comprising one of a temperature sensor, and moisture sensor and flow sensor located on the containment vessels and connected for communication with the microcontroller.

9. The active multicompartment pressure redistribution system of claim 1 further comprising a flow sensor connected for communication with the flow regulator.

10. The active multicompartment pressure redistribution system of claim 1 further comprising a flexible ring for holding the pressure sensors in place on the containment vessel.

11. The active multicompartment pressure redistribution system of claim 10 further comprising an electrically and light conductive material holding the flexible ring of the pressure sensor in place on the containment vessel whereby signals from the pressure sensor are carried by the electrically and light conductive material.

12. The active multicompartment pressure redistribution system of claim 1 wherein the microcontroller has both analog and digital outputs and inputs.

13. The active multicompartment pressure redistribution system of claim 1 wherein the microcontroller is connected to a communication device containing an antenna and wireless communication device.

14. The active multicompartment pressure redistribution system of claim 13 further comprising multiple matrixes of containment vessels, each matrix communicating with another matrix by way of the respective wireless communication device.

15. The active multicompartment pressure redistribution system of claim 13 further comprising a third party smart device communicating with the microcontroller by way of the wireless communication device.

* * * * *